US010420195B2

(12) United States Patent
Sakurai et al.

(10) Patent No.: US 10,420,195 B2
(45) Date of Patent: Sep. 17, 2019

(54) LIGHTING FIXTURE

(71) Applicant: PANASONIC INTELLECTUAL PROPERTY MANAGEMENT CO., LTD., Osaka (JP)

(72) Inventors: Satoru Sakurai, Osaka (JP); Naoki Komatsu, Hyogo (JP); Koji Matsushita, Osaka (JP); Toshizumi Okada, Osaka (JP); Ryousuke Ijichi, Osaka (JP); Yuzuru Tanaka, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 93 days.

(21) Appl. No.: 15/891,838

(22) Filed: Feb. 8, 2018

(65) Prior Publication Data

US 2018/0249559 A1 Aug. 30, 2018

(30) Foreign Application Priority Data

Feb. 24, 2017 (JP) ..... 2017-033949

(51) Int. Cl.

| | |
|---|---|
| ***H05B 37/02*** | (2006.01) |
| ***F21V 23/00*** | (2015.01) |
| ***F21V 21/26*** | (2006.01) |
| ***F21V 23/02*** | (2006.01) |
| ***F21V 21/30*** | (2006.01) |
| ***F21V 21/35*** | (2006.01) |
| ***F21V 23/04*** | (2006.01) |
| *F21Y 115/10* | (2016.01) |

(52) U.S. Cl.

CPC ..... *H05B 37/0272* (2013.01); *F21V 21/26* (2013.01); *F21V 21/30* (2013.01); *F21V 21/35* (2013.01); *F21V 23/008* (2013.01); *F21V 23/023* (2013.01); *F21V 23/045* (2013.01); *F21Y 2115/10* (2016.08)

(58) Field of Classification Search

CPC . H05B 37/0272; F21V 23/008; F21V 23/023; F21V 21/26

See application file for complete search history.

(56) References Cited

U.S. PATENT DOCUMENTS

2017/0307196 A1* 10/2017 Matsui ..... F21V 29/763

FOREIGN PATENT DOCUMENTS

JP 2014-146503 8/2014

* cited by examiner

*Primary Examiner* — Karabi Guharay

(74) *Attorney, Agent, or Firm* — Greenblum & Bernstein, P.L.C.

(57) ABSTRACT

A lighting fixture for attaching to an attachment component is provided. A lamp includes a light source that emits illumination light. A power supply includes a power supply circuit that generates power for causing the light source to emit the illumination light and a power supply housing that houses the power supply circuit. An arm couples the lamp and the power supply and rotatably supports the lamp. The power supply housing houses an infrared communication receiver that receives an infrared signal for controlling the lighting fixture and a radio communication circuit that receives a radio signal for controlling the lighting fixture. The power supply housing includes a first opening through which the infrared communication receiver receives the infrared signal.

13 Claims, 9 Drawing Sheets

LIGHTING FIXTURE

CROSS REFERENCE TO RELATED APPLICATION

This application claims the benefit of priority of Japanese Patent Application Number 2017-033949 filed on Feb. 24, 2017, the entire content of which is hereby incorporated by reference.

BACKGROUND

1. Technical Field

The present disclosure relates to a lighting fixture such as a spotlight.

2. Description of the Related Art

A spotlight includes, for example, a lamp that emits illumination light, a power supply including a power supply box that houses a power supply circuit, and an arm that couples the lamp and the power supply (for example, see Japanese Unexamined Patent Application Publication No. 2014-146503).

With this type of spotlight, the angles of the portion that couples the lamp and the arm together and the portion that couples the power supply and the arm together are freely adjustable. This makes it possible to freely change the orientation of the lamp and thus change the direction in which light is emitted from the lamp.

SUMMARY

Spotlights having an individual dimming function so as to allow for brightness to be adjusted one by one are being developed. In such a case, it is conceivable to provide a diming knob in the power supply box.

However, since spotlights are installed in high locations, when a dimming knob is provided in the power supply box, one must go to the high location where the dimming knob is to adjust the dimming each time. Thus, controlling the dimming with such a configuration is not only laborious but dangerous as the user needs to posture his or her body upward in order to adjust the dimming. Thus, conventional spotlights are problematic in that controlling the dimming is difficult.

The present disclosure has been conceived to overcome the above problem, and has an object to provide a lighting fixture that can be easily controlled. For example, the dimming of the lighting fixture can be easily controlled.

In order to achieve this object, a lighting fixture according to one aspect of the present invention is for attaching to an attachment component and includes: a lamp including a light source that emits illumination light; a power supply that includes a power supply circuit that generates power for causing the light source to emit the illumination light and a power supply housing that houses the power supply circuit; and an arm that couples the lamp and the power supply and rotatably supports the lamp. The power supply housing houses an infrared communication receiver that receives an infrared signal for controlling the lighting fixture and a radio communication circuit that receives a radio signal for controlling the lighting fixture. The power supply housing includes a first opening through which the infrared communication receiver receives the infrared signal.

According to the present disclosure, it is easy to control the lighting fixture, such as control the dimming of the lighting fixture.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT

The following describes an exemplary embodiment of the present disclosure with reference to the drawings. The embodiment described below is merely one specific example of the present disclosure. The numerical values, shapes, materials, elements, arrangement and connection of the elements, etc., indicated in the following embodiment are given merely by way of illustration and are not intended to limit the present disclosure. Therefore, among elements in the following embodiment, those not recited in any one of the independent claims defining the broadest inventive concept of the present disclosure are described as optional elements.

Note that the figures are schematic illustrations and are not necessarily precise depictions. Moreover, in the figures, elements that are essentially the same share like reference signs. Accordingly, duplicate description is omitted or simplified.

In the written description and drawings, the X, Y, and Z axes indicate the three axes in a three-dimensional orthogonal coordinate system, and in this embodiment, directions parallel to the Z axis extend in vertical directions, and directions perpendicular to the Z axis (i.e., directions parallel to the XY plane) extend in horizontal directions. The X and Y axes are orthogonal to one another and the Z axis.

EMBODIMENT

Figure 1:
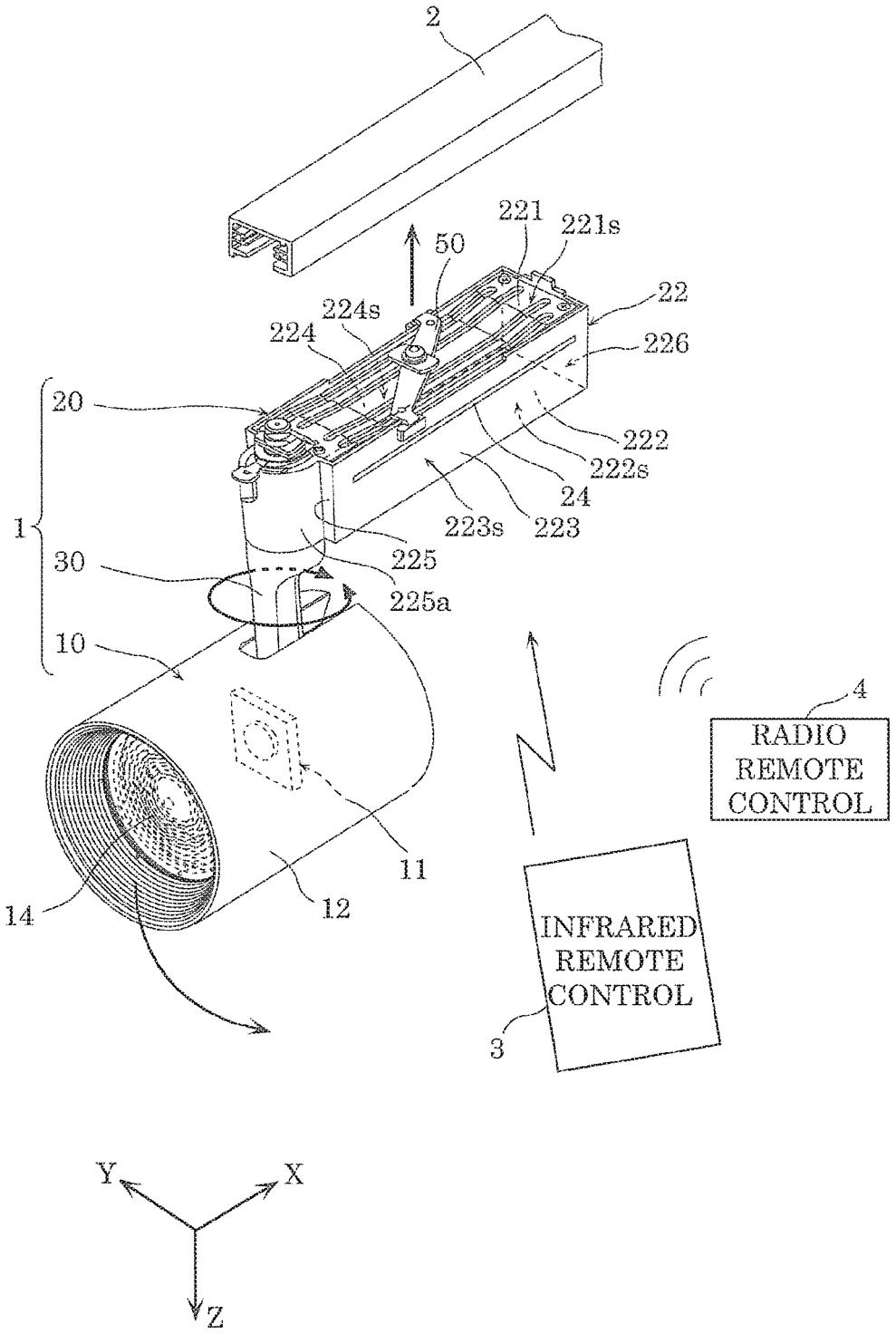
FIG. 1 is an external perspective view of a lighting fixture according to an embodiment.
Figure 2:
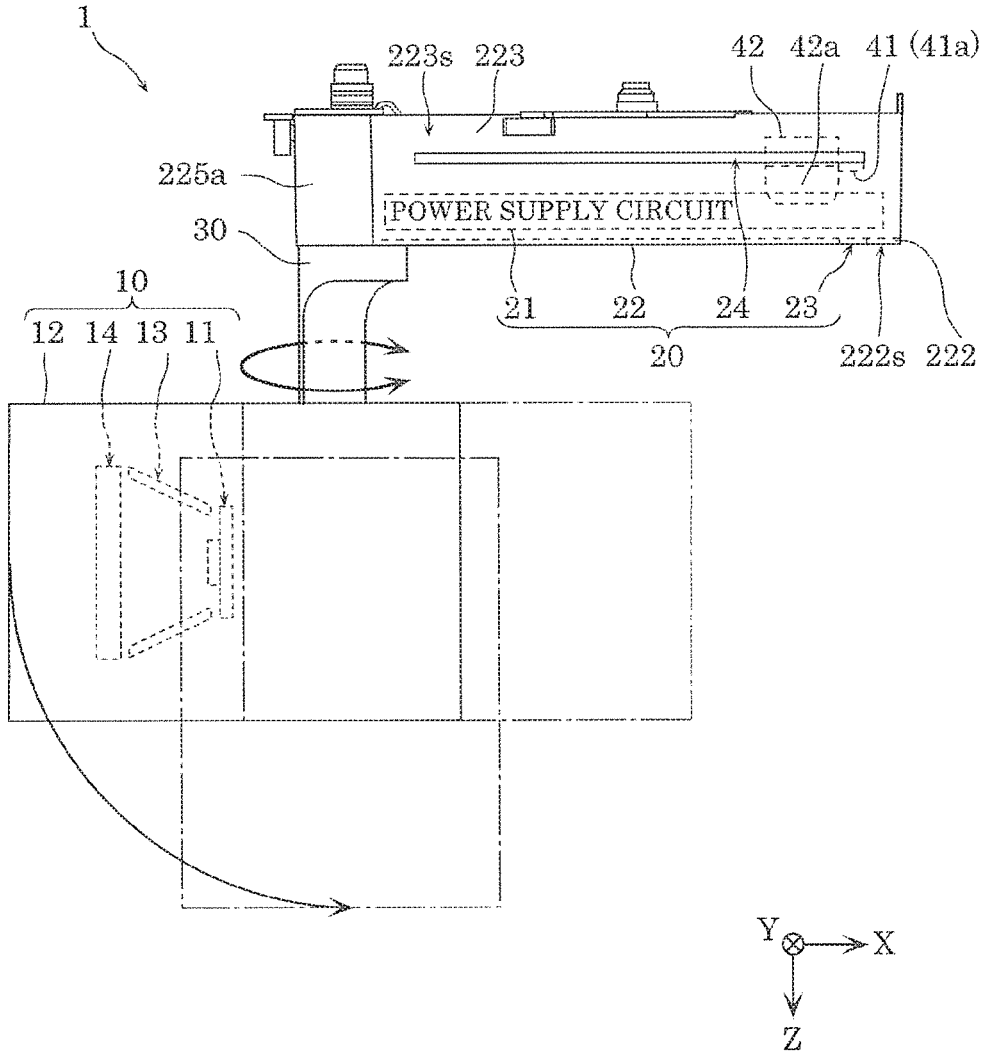
FIG. 2 is a side view of a lighting fixture according to an embodiment.
Figure 3:
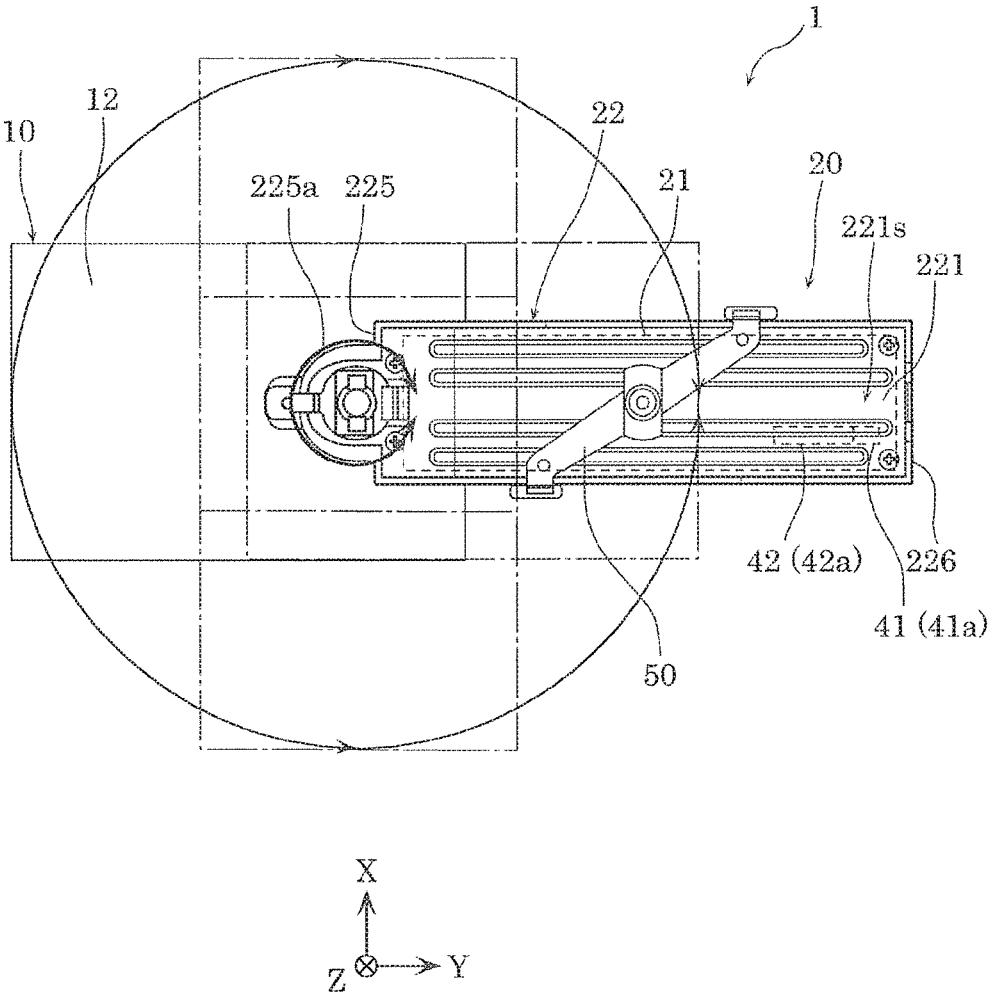
FIG. 3 is a top view of a lighting fixture according to an embodiment.
Figure 4:
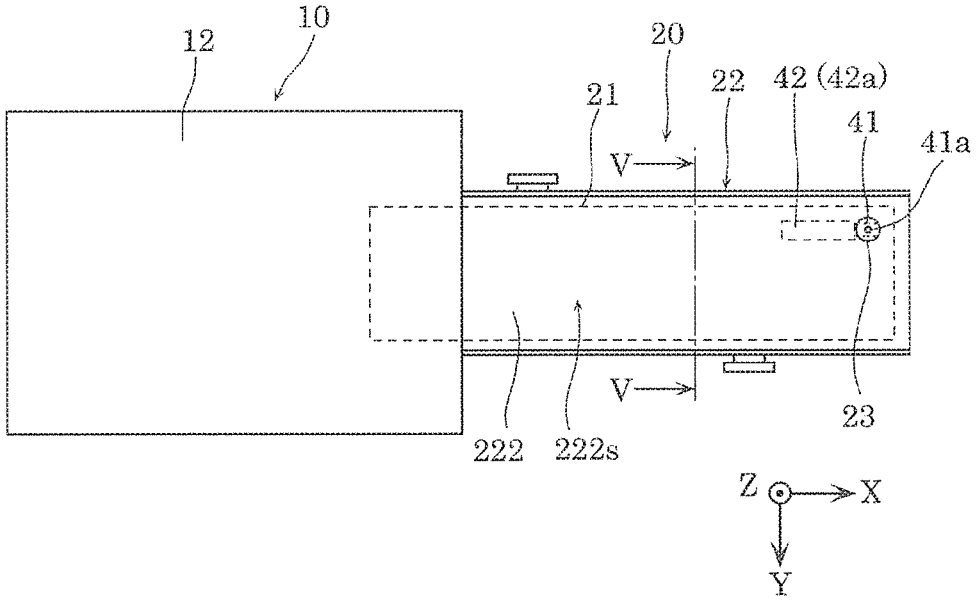
FIG. 4 is a bottom view of a lighting fixture according to an embodiment.
Figure 5:
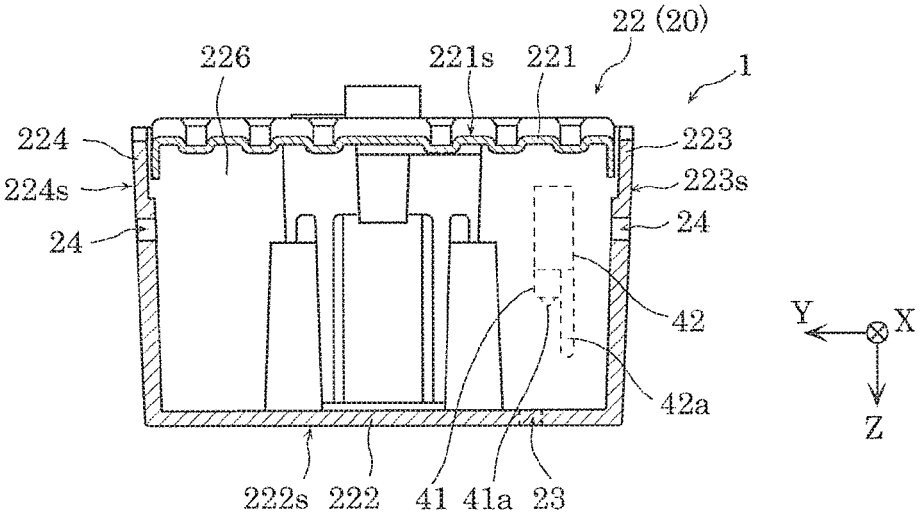
FIG. 5 is a cross sectional view of a lighting fixture according to an embodiment.

First, lighting fixture 1 according to an embodiment will be described with reference to FIG. 1 through FIG. 5. FIG. 1 is a perspective view of lighting fixture 1 according to this embodiment. FIG. 2 is a side view of the same lighting fixture 1. FIG. 3 is a top view of the same lighting fixture 1. FIG. 4 is a bottom view of the same lighting fixture 1. FIG. 5 is a cross sectional view of the same lighting fixture 1, taken at line V-V in FIG. 4. Note that power supply circuit 21 is not illustrated in FIG. 5.

As illustrated in FIG. 1, lighting fixture 1 is, for example, a spotlight that is installed on, for example, lighting duct 2 (wiring duct), and includes lamp 10 that emits illumination light, power supply 20, and arm 30 that couples lamp 10 and power supply 20.

Lighting duct 2 is one example of an attachment component to which lighting fixture 1 attaches, and is installed on part of a building, such as, the ceiling, beam, or wall of a building. Lighting fixture 1 receives a supply of AC power (grid power, etc.) from lighting duct 2 as a result of being attached to lighting duct 2. Note that lighting fixture 1 is not limited to the example of being installed on lighting duct 2; lighting fixture 1 may be attached directly to a part of the building. In such a case, the part of the building functions as the attachment component.

Next, each component included in lighting fixture 1 according to this embodiment will be described in detail with reference to FIG. 1 through FIG. 5.

(Lamp)

Lamp 10 includes light source 11 that emits illumination light, lamp main body 12 that supports light source 11, and reflector 13 and lens 14 disposed on the light emission side of light source 11.

Light source 11 is a light source module that emits white light as the illumination light. In this embodiment, light source 11 is an LED module including light emitting diodes (LEDs) as sources of light. In one example, light source 11 is a chip on board (COB) LED module including a substrate, LEDs mounted on the substrate, and a sealant that seals the LEDs. The LEDs and the sealant collectively function as a light emitter in light source 11.

The substrate is a mounting substrate for mounting the LEDs, and, for example, is a ceramic substrate, a resin substrate, or a metal-based substrate. Note that a pair of electrode terminals for receiving DC power from power supply 20 and metal structures formed in a predetermined pattern for electrically connecting the LEDs may be formed on the substrate.

The LEDs are, for example, bare chips that emit monochromatic visible light. For example, blue LED chips that emit blue light when current passes through can be used as the LEDs. The LEDs are arranged in, for example, a matrix on the substrate. Note that the LEDs need not be provided in plurality; at least one LED is sufficient.

The sealant is, for example, a light-transmissive resin. The sealant according to this embodiment includes phosphor as a wavelength converter that converts the wavelength of light from the LEDs. The sealant is, for example, a phosphor-containing resin such as a silicon resin dispersed with phosphor. When the LEDs are blue LED chips that emit blue light, in order to achieve a white light, YAG yellow phosphor particles, for example, can be used as the phosphor particles. In such a case, the yellow phosphor absorbs part of the blue light emitted by the blue light LED chips which excites and causes the yellow phosphor to emit yellow light. The yellow light then mixes with the blue light unabsorbed by the yellow phosphor, resulting in emission of white light from light source 11.

Moreover, light source 11 according to this embodiment is a light source module that can perform dimming control and color adjustment control. Accordingly, light source 11 includes, for example, a plurality of light emitters that emit light of different colors or color temperatures. In such a case, it is possible to change the color and color temperature of each of the light emitters by using LEDs that emit light of different colors and/or adjusting the type and amount of the wavelength converter (phosphor) used.

Light source 11 configured in this manner is fixed to lamp main body 12 via a fastener, such as a screw or bolt. Moreover, the pair of electrode terminals provided on the substrate in light source 11 and an output terminal of power supply circuit 21 in power supply 20 are connected via, for example, a lead wire. With this, light source 11 is supplied with power from power supply 20 and emits light.

Lamp main body 12 is a support component that supports light source 11, reflector 13, and lens 14, and is an outer case that defines the silhouette of lamp 10. Lamp main body 12 also functions as a heat sink that disperses heat generated by light source 11. Accordingly, lamp main body 12 is desirably made of a material having a high rate of heat transfer, such as a metal such as aluminum or a highly thermally conductive resin. In this embodiment, lamp main body 12 is made of die cast aluminum. Moreover, lamp main body 12 is shaped such that its outer surface forms the surface of a cylinder, but the shape of lamp main body 12 is not limited to this example.

Reflector 13 is a reflective component that reflects light emitted by light source 11. More specifically, the inner surface of reflector 13 is a reflective surface that reflects light from light source 11. The reflective surface allows reflector 13 to direct the light emitted by light source 11 in a desired direction. In this embodiment, reflector 13 controls the distribution of light such that the light emitted by light source 11 is incident on lens 14.

For example, reflector 13 may be a white resin-formed piece produced using a resin material such as polybutylene terephthalate (PBT), may be a resin-formed piece including a metal film such as an aluminum film formed on the inner surface, and may be a metal piece formed from a metal material such as aluminum.

Lens 14 is arranged so as to cover light source 11 and the opening of reflector 13. More specifically, lens 14 has a function of controlling, in a predetermined direction, the distribution of light from light source 11 and light reflected by reflector 13. In one example, lens 14 is a Fresnel lens. With this, lens 14 can collect incident light and emit illumination light from lamp 10 in the shape of a spot (i.e., emit spotlight).

Lens 14 is formed from a light-transmissive material having light transmitting properties. More specifically, lens 14 is made of a transparent resin material such as acrylic or polycarbonate, or a glass material.

(Power Supply)

Power supply 20 has a power supply function, and generates and supplies to lamp 10 power for causing light source 11 (lamp 10) to emit light. Since light source 11 according to this embodiment is driven by DC power, DC power is supplied from power supply 20 to lamp 10.

Power supply 20 includes power supply circuit 21 having a power supply function and power supply housing 22 that houses power supply circuit 21. Power supply 20 further includes infrared communication receiver 41 that receives an infrared signal (infrared light) and radio communication circuit 42 that receives a radio signal.

Power supply circuit 21 generates power for causing light source 11 to emit light. More specifically, power supply circuit 21 converts AC power supplied from an external source into DC power. The DC power generated by power supply circuit 21 is supplied to light source 11 via a power cable routed through arm 30.

In this embodiment, in addition to a power supply function, power supply 20 further has a lighting control function of controlling a lighting aspect of lamp 10 (light source 11). More specifically, power supply 20 controls, via a controller including a control circuit, a lighting aspect of (an aspect of the light emitted by) light source 11 in accordance with an infrared signal received by infrared communication receiver 41 or a radio signal received by radio communication circuit 42. For example, via the control circuit, power supply 20 turns on or off lamp 10 (light source 11) or changes the brightness, color, and/or color temperature of lamp 10 (light source 11). In this embodiment, the controller (control circuit) is included in the same circuit board as power supply circuit 21.

Power supply circuit 21 is a power supply circuit, and includes a circuit board and a plurality of circuit elements mounted on the circuit board. The circuit board is a printed circuit board on which metal structures are printed in a predetermined pattern. In addition to circuit elements (circuit components), infrared communication receiver 41 and radio communication circuit 42 may be provided on the circuit board. Infrared communication receiver 41 and radio communication circuit 42 are electrically connected to metal structures on the circuit board. The plurality of circuit elements include, for example, power supply circuit elements included in the power supply circuit that generates power for causing light source 11 to emit light, and control circuit elements included in the control circuit that controls a lighting aspect of light source 11.

The power supply circuit elements included in the power supply circuit and the control circuit elements included in control circuit include, for example, capacitive components (e.g., electrolytic capacitors, ceramic capacitors), resistive components (e.g., resistors), rectifiers, inductors, transistors, noise filters, diodes, integrated circuit (IC) components, and/or semiconductor components (e.g., FETs).

The power supply circuit (power supply circuit 21) converts AC power supplied from, for example, an external power supply, such as a utility power supply, to DC power of a predetermined level by, for example, rectifying, smoothing, and stepping down the power. The control circuit includes, for example a dimming control circuit and a color adjustment control circuit. The DC power output from the power supply circuit is controlled by the control circuit.

Power supply housing 22 is a power supply box, and, for example, is a metal case made of a metal material such as aluminum. In this embodiment, power supply housing 22 is made of die cast aluminum, but may be made of metal panels.

Power supply housing 22 also houses infrared communication receiver 41 and radio communication circuit 42 in addition to power supply circuit 21. Note that power supply housing 22 may also house other components.

Power supply housing 22 is, for example, an elongated approximately cuboid housing, and includes top panel 221, bottom panel 222, first lateral panel 223, second lateral panel 224, front panel 225, and rear panel 226. Top panel 221, bottom panel 222, first lateral panel 223, and second lateral panel 224 are approximately elongated rectangular shaped panels.

Top panel 221 serves as the ceiling panel of power supply housing 22, and the outer surface thereof is top surface 221*s*. Top surface 221*s* is an attachment surface for attaching power supply housing 22 to an attachment component (for example, a lighting duct). Lever 50 that detachably attaches to lighting duct 2 is provided on top panel 221. Lever 50 is rotatably provided on power supply housing 22, and has a structure that engages with a duct rail of lighting duct 2 by rotating in the groove of lighting duct 2.

Bottom panel 222 serves as the base panel of power supply housing 22, and the outer surface thereof is bottom surface 222*s*. Bottom surface 222*s* and top surface 221*s* (attachment surface) face in opposite directions. As illustrated in FIG. 4, first opening 23 is formed in bottom surface 222*s*.

First opening 23 is an infrared opening through which infrared signals to be received by infrared communication receiver 41 pass. First opening 23 is a through-hole penetrating through bottom panel 222. First opening 23 is, for example, a circular opening. First opening 23 is, for example, a small-diameter opening whose diameter is, for example, in a range of from 5 mm to 20 mm. In this way, by implementing first opening 23 as a small-diameter opening, first opening 23 can be inhibited from being noticeable, which makes it possible to avoid a negative impact on the design aesthetics of power supply housing 22. In this embodiment, first opening 23 is a circular opening having a diameter of 10 mm. Note that first opening 23 is not limited to a circular shape; first opening 23 may be elliptical.

The outer surface of first lateral panel 223 is first lateral surface 223*s*. The outer surface of second lateral panel 224 is second lateral surface 224*s*. As illustrated in FIG. 1, FIG. 2, and FIG. 5, second opening 24 is formed in each of first lateral surface 223*s* and second lateral surface 224*s*. Note that second opening 24 may be formed in at least one of first lateral surface 223*s* and second lateral surface 224*s*.

Each second opening 24 is a radio signal opening through which radio signals to be received by radio communication circuit 42 pass. The second opening 24 formed in first lateral panel 223 is a through-hole penetrating through first lateral panel 223. Second openings 24 are elongated slits. In this embodiment, the shape of the opening of each second opening 24 is an elongated approximate rectangle extending in the lengthwise direction of power supply housing 22 (i.e., along the X axis). More specifically, each second opening 24 is formed in a straight line from one end of first lateral panel 223 (second lateral panel 224) to the other end.

In this embodiment, since the frequency of the radio signal is on the UHF band, the lengthwise dimension of each second opening 24 is in a range of from 50 mm to 500 mm. For example, when a frequency in the 920 MHz band is used for the radio signal, the length of each second opening 24 may be approximately 140 mm or more. In this embodiment, each second opening 24 is a straight line slit having a width of 2 mm and a length of 160 mm.

Note that arm support 225*a* that rotatably supports one end of arm 30 is provided on front panel 225.

(Arm)

Arm 30 rotatably supports lamp 10. One end of arm 30 is connected to lamp 10 and the other end is connected to power supply 20.

The angle of the portion that couples arm 30 and lamp 10 together is freely adjustable, and lamp 10 is rotatably supported relative to arm 30. More specifically, lamp 10 illustrated in FIG. 1 can rotate such that the light emission direction changes from a horizontal direction to a vertical direction. In this embodiment, lamp 10 is connectively fixed to arm 30 such that, from the state illustrated in FIG. 2, the maximum rotation angle in the XY plane is 90 degrees.

Moreover, the angle of the portion that couples arm 30 and power supply 20 together is also freely adjustable, and arm 30 is rotatably supported relative to power supply 20 (power supply housing 22). More specifically, arm 30 is configured so as to be capable of rotating horizontally relative to power supply 20. With this, lamp 10 supported by arm 30 can also rotate horizontally. In this embodiment, lamp 10 (arm 30) can, from the state illustrated in FIG. 3, rotate 180 degrees left and 180 degrees right in the XY plane.

In FIG. 2 and FIG. 3, the dotted and dashed lines each indicate an example of the range of movement of lamp 10. In other words, lamp 10 is capable of moving to the positions indicated by the dotted and dashed lines in FIG. 2 and FIG. 3.

Arm 30 is made of a metal material such as aluminum. In this embodiment, arm 30 is made of die cast aluminum. Note that an insertion hole is provided inside arm 30 for inserting a power cable that electrically connects light source 11 of lamp 10 and power supply circuit 21 of power supply 20 together.

(Communication Module)

Infrared communication receiver 41 receives an infrared signal for controlling lighting fixture 1. Infrared communication receiver 41 includes infrared receiver 41*a* that receives an infrared signal and a processing circuit (IC) that processes the infrared signal received by the infrared receiver. For example, infrared receiver 41*a* receives infrared light forming the infrared signal. The infrared signal received by infrared receiver 41*a* is converted into a predetermined control signal (electrical signal) by the processing circuit, and output to the controller and power supply circuit 21 in power supply 20.

As illustrated in FIG. 1, the infrared signal received by infrared communication receiver 41 is, for example, transmitted from infrared remote control 3 which has an infrared transmission function. In other words, lamp 10 and infrared remote control 3 both have an infrared communication function. In one example, the infrared signal has a wavelength of 945 nm, but the infrared signal is not limited to this example.

Infrared remote control 3, which performs infrared communication with infrared communication receiver 41, is operated by a user. An infrared signal for controlling lighting fixture 1 is transmitted from infrared remote control 3 in response to the user operating infrared remote control 3.

In this embodiment, for example, an infrared signal (individual lighting control infrared signal) for controlling a lighting aspect of the illumination light emitted by lamp 10 (light source 11) is transmitted from infrared remote control 3. In such a case, infrared communication receiver 41 of lighting fixture 1 receives, as an infrared signal for controlling lighting fixture 1, an infrared signal (individual lighting control infrared signal) for controlling a lighting aspect of the illumination light from light source 11.

More specifically, the user can turn on or off lighting fixture 1, adjust the dimming of lighting fixture 1, and adjust the color of illumination light emitted by lighting fixture 1 by transmitting a lighting control infrared signal to lighting fixture 1 by operating infrared remote control 3. In other words, the user operates infrared remote control 3 when the user wants to individually control a single lighting fixture 1. With this, an infrared signal for turning on or off lamp 10 (light source 11) or an infrared signal for controlling the dimming or color adjustment of lamp 10 (light source 11) is transmitted from infrared remote control 3.

Moreover, an infrared signal (pairing infrared signal) for pairing lighting fixture 1 and radio remote control 4 is also transmitted from infrared remote control 3. In such a case, infrared communication receiver 41 of lighting fixture 1 receives, as an infrared signal for controlling lighting fixture 1, an infrared signal (pairing infrared signal) for associating lighting fixture 1 with radio remote control 4.

Radio communication circuit 42 receives a radio signal for controlling lighting fixture 1. Radio communication circuit 42 includes radio antenna 42*a* that receives the radio signal, and a processing circuit (IC) that processes the radio signal received by radio antenna 42*a*. For example, radio antenna 42*a* includes, as a radio antenna that receives a radio signal, an antenna patterned on a substrate. The radio signal received by radio antenna 42*a* is converted into a predetermined control signal (electrical signal) by the processing circuit, and output to the controller and power supply circuit 21 in power supply 20. Note that as described above, the frequency of the radio signal received by radio communication circuit 42 is on the UHF band, and in one example, is on the 920 MHz band, but the frequency is not limited to this example.

The radio signal received by radio communication circuit 42 is, for example, transmitted from radio remote control 4 (radio remote control), which has a radio transmission function. Radio remote control 4 may be a mobile, handheld terminal, and, alternatively, may be attached to, for example, the wall. Radio remote control 4 is, for example, installed on a wall in a room, and performs various types of control with respect to one or more lighting fixtures 1 installed in the room.

Radio remote control 4, which performs radio communication with radio communication circuit 42, is operated by a user. A radio signal for controlling lighting fixture 1 is transmitted from radio remote control 4 in response to the user operating radio remote control 4.

In this embodiment, a radio signal (pairing radio signal) for pairing radio remote control 4 and lighting fixture 1 is also transmitted from that radio remote control 4. In such a case, radio communication circuit 42 of lighting fixture 1 receives, as a radio signal for controlling lighting fixture 1, a radio signal (pairing radio signal) for associating radio remote control 4 and that lighting fixture 1.

Moreover, a radio signal (collective lighting control radio signal) for simultaneously controlling a plurality of lighting fixtures 1 belonging to a single group including radio remote control 4 and a plurality of lighting fixtures 1 paired with radio remote control 4 is transmitted from radio remote control 4. In such a case, radio communication circuit 42 of lighting fixture 1 receives, as a radio signal for controlling lighting fixture 1, a radio signal (collective lighting control radio signal) for simultaneously controlling a plurality of lighting fixtures 1 paired with radio remote control 4 (i.e., a plurality of lighting fixtures 1 belonging to a single group).

Next, an example of a case in which lighting fixture 1 is controlled using infrared remote control 3 and radio remote control 4 will be given. The example will focus on the method for setting up the pairing in particular.

First, radio remote control 4 is placed into pairing mode by operating radio remote control 4, and a paring radio signal is transmitted from radio remote control 4 to lighting fixture 1. With this, radio communication circuit 42 of lighting fixture 1 receives the pairing radio signal from radio remote control 4. Here, one or more lighting fixtures 1 may be paired with radio remote control 4. The one or more lighting fixtures 1 that receive the pairing radio signal become candidates for pairing with radio remote control 4.

Next, while the pairing radio signal is being transmitted from radio remote control 4, infrared remote control 3 can be operated so as to transmit a pairing infrared signal to a specific lighting fixture 1 that is to be paired with radio remote control 4. The pairing infrared signal transmitted by infrared remote control 3 is received by infrared communication receiver 41 of lighting fixture 1.

With this, the specific lighting fixture 1 that received the pairing infrared signal is paired with radio remote control 4 that transmits the pairing radio signal. When pairing involves a plurality of lighting fixtures 1, each infrared remote control 3 corresponding to the plurality of lighting fixtures 1 are operated sequentially, whereby pairing infrared signal are transmitted sequentially to the plurality of lighting fixtures 1. This makes it possible to pair the one specific radio remote control 4 and the specific lighting fixtures 1.

Then, a lighting aspect is controlled simultaneously for the one or more specific lighting fixtures 1 paired with the specific radio remote control 4 via a collective lighting control radio signal from the specific radio remote control 4. In other words, when the setup of the pairing is complete, it is possible to simultaneously turn on or off and simultaneously adjust the dimming of the plurality of paired specific lighting fixtures 1 belonging to a single group, simply by operating a single specific radio remote control 4.

Moreover, it is possible to individually control the lighting aspects of each lighting fixture 1 even after pairing of the plurality of lighting fixtures 1 is completely by operating infrared remote control 3 corresponding to lighting fixture 1 to be controlled.

Note that in this embodiment, radio communication circuit 42 has only the function of receiving radio signals, but radio communication circuit 42 may have a function of transmitting radio signals as well. In such a case, if radio remote control 4 is capable of receiving radio signals, radio remote control 4 can receive a radio signal transmitted by radio communication circuit 42.

As described above, infrared communication receiver 41 and radio communication circuit 42 are housed in power supply housing 22. In this embodiment, infrared communication receiver 41 and radio communication circuit 42 are integrated as a single communication module, and are housed in a single resin case. Accordingly, the processing circuit in infrared communication receiver 41 and the processing circuit in radio communication circuit 42 are integrated in a single package (single chip) and thus housed in a common package. In other words, infrared communication receiver 41 and radio communication circuit 42 are implemented as a single component.

Infrared signals reach infrared receiver 41*a* of infrared communication receiver 41 through first opening 23 formed in power supply housing 22. As illustrated in FIG. 4, in a view of bottom surface 222*s* of power supply housing 22, first opening 23 is formed in a location that overlaps infrared receiver 41*a* of infrared communication receiver 41. In other words, infrared receiver 41*a* of infrared communication receiver 41 is disposed so as to be visible through first opening 23.

Moreover, as can be inferred from the range of movement of lamp 10 indicated by the dotted and dashed lines in FIG. 2 and FIG. 3, first opening 23 is formed in a location that does not overlap lamp 10 regardless of the orientation of lamp 10.

On the other hand, radio signals reach radio antenna 42*a* of radio communication circuit 42 through second opening 24 formed in power supply housing 22. In such a case, second opening 24 (the slit) functions as a slot antenna that is electromagnetically coupled with radio antenna 42*a* of radio communication circuit 42. For example, when a radio signal is (electromagnetic waves are) transmitted toward power supply housing 22, an electric field is generated in the widthwise direction of second opening 24 by the radio signal whereby second opening 24 functions as an antenna, and the received radio signal radiates toward radio antenna 42*a* of radio communication circuit 42. Moreover, similarly, when radio antenna 42*a* of radio communication circuit 42 transmits a radio signal, an electric field is generated in the widthwise direction of second opening 24 by the radio signal whereby second opening 24 functions as an antenna, and the radio signal radiates outward.

By configuring second opening 24 so as to function as a slot antenna, it is possible to dispose radio communication circuit 42 inside power supply housing 22, in a location close to second opening 24. In this embodiment, along with infrared communication receiver 41, radio communication circuit 42 is disposed near second opening 24 formed in first lateral panel 223.

Moreover, in this embodiment, since second opening 24 is formed in first lateral panel 223, radio antenna 42*a* is disposed standing up, as illustrated in FIG. 2 through FIG. 5. More specifically, radio antenna 42*a* is disposed such that a major surface thereof faces first lateral panel 223. Even more specifically, a major surface of radio antenna 42*a* (of the substrate on which an antenna is patterned) is parallel to first lateral surface 223*s* of first lateral panel 223. By disposing radio antenna 42*a* standing up, radio signals transmitted toward lighting fixture 1 easily reach radio antenna 42*a* through second opening 24, improving radio communication performance.

SUMMARY

With lighting fixture 1 according to this embodiment, power supply housing 22 houses infrared communication receiver 41 and radio communication circuit 42. Power supply housing 22 has first opening 23 through which infrared communication receiver 41 receives an infrared signal.

This configuration makes it possible to control the dimming of lighting fixtures 1 individually via infrared communication using infrared remote control 3. Accordingly, the user can easily perform control over a lighting fixture, such as turning lighting fixture 1 on or off, controlling the dimming, or pairing lighting fixture 1, without having to directly operate lighting fixture 1.

Moreover, in lighting fixture 1 according to this embodiment, first opening 23 is formed in bottom surface 222*s* of bottom panel 222 of power supply housing 22.

As is the case in this embodiment, lighting fixture 1, such as a spotlight, is often installed on the ceiling of a building or above the beams in a building, and as such, by forming first opening 23 in bottom panel 222 of power supply housing 22, it is possible for infrared signals to easily pass through first opening 23. Accordingly, it is further easier for the user to perform various types of control over a lighting fixture.

Moreover, in lighting fixture 1 according to this embodiment, in a view of the surface of power supply housing 22 in which first opening 23 is formed (i.e., in a view of bottom surface 222*s*), first opening 23 is formed in a location that overlaps infrared receiver 41*a* of infrared communication receiver 41.

The infrared signals transmitted from, for example, infrared remote control 3 travel in a straight line, with a high degree of directionality. Accordingly, by forming first opening 23 in a location that overlaps with infrared receiver 41*a* of infrared communication receiver 41, infrared signals that have passed through first opening 23 easily reach infrared receiver 41*a*. This makes it even easier for the user to perform dimming control.

Moreover, in lighting fixture 1 according to this embodiment, first opening 23 is formed in a location that does not overlap lamp 10 regardless of the orientation of lamp 10.

With this, first opening 23 will not become blocked by lamp 10 even if the orientation of lamp 10 is changed. In other words, first opening 23 will not become covered by lamp 10. This makes it possible to perform infrared configuration regardless of the orientation of lamp 10. In other words, it is possible to perform infrared communication without sacrificing the spotlight function of lamp 10, i.e., that the location of lighting spot can be freely changed by moving of lamp 10.

Moreover, in lighting fixture 1 according to this embodiment, metal power supply housing 22 has second opening 24 through which radio communication circuit 42 receives a radio signal.

The type of opening (through-hole) suitable for infrared signals differs from the type of opening (through-hole) suitable for radio signal. Accordingly, by forming second opening 24 separate from first opening 23 and shaped so as to be suitable for radio communication, it is possible to realize lighting fixture 1 capable of easily performing radio communication in addition to infrared communication. In other words, the user can appropriately perform two types of communication: infrared communication and radio communication.

In particular, since both infrared communication receiver 41 and radio communication circuit 42 can receive dimming signals, it is possible to realize lighting fixture 1 that is capable of performing dimming control via two types of communication: infrared communication and radio communication. Accordingly, in such a case, the user can perform dimming control without having to be aware of which remote control—infrared remote control 3 or radio remote control 4—to operate.

Moreover, in lighting fixture 1 according to this embodiment, second opening 24 is an elongated slit.

If the opening through which radio signals pass is at least a certain length dependent on frequency, the radio signals can easily pass through regardless of the width of the opening. Accordingly, by forming second opening 24 as an elongated slit, radio communication performance can be improved while maintaining the excellent design aesthetics of lighting fixture 1 (power supply housing 22).

Moreover, in lighting fixture 1 according to this embodiment, second opening 24 is formed in first lateral surface 223*s* of first lateral panel 223 of power supply housing 22. Moreover, radio antenna 42*a* of radio communication circuit 42 is disposed such that a major surface of radio antenna 42*a* faces first lateral surface 223*s* of first lateral panel 223.

Radio communication circuit 42 has radio communication directionality depending on its relationship with radio antenna 42*a*, but as a result of research by the inventors, they discovered that radio communication performance varies greatly depending on the relationship between the location of second opening 24 and the orientation of radio antenna 42*a* of radio communication circuit 42.

Accordingly, as described in this embodiment, by forming second opening 24 in first lateral panel 223 of power supply housing 22 and orienting a major surface of radio antenna 42*a* of radio communication circuit 42 so as to face first lateral surface 223*s* of first lateral panel 223 (i.e., by standing radio antenna 42*a* upright), the inventors were able to greatly improve radio communication performance.

Note that when radio antenna 42*a* is disposed standing up, the same technical advantages are also achieved for second opening 24 formed in second lateral panel 224, but disposing radio antenna 42*a* near second opening 24 yields better communication performance.

Variation 1

Figure 6:
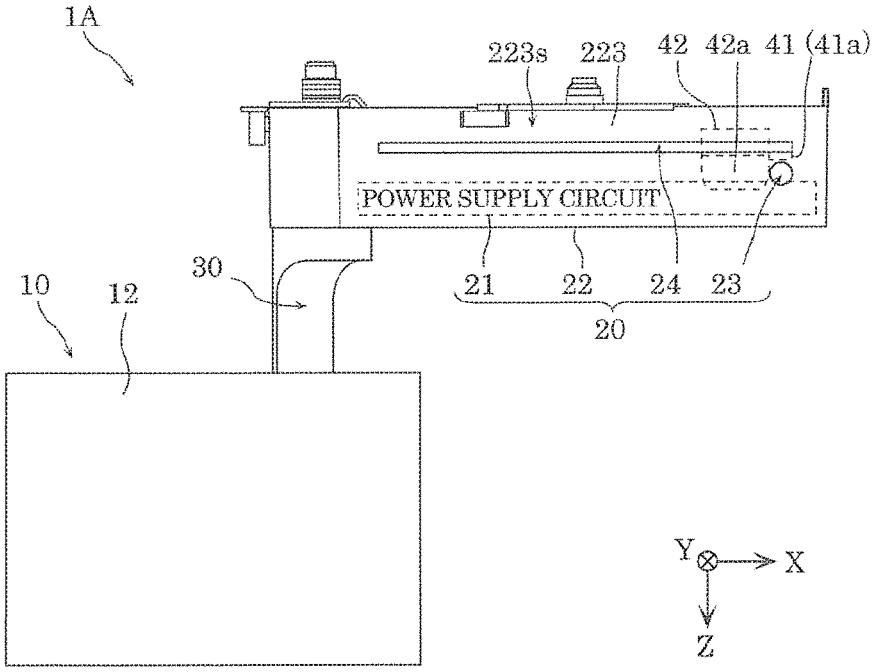
FIG. 6 is a side view of a lighting fixture according to Variation 1.

Next, lighting fixture 1A according to Variation 1 will be described with reference to FIG. 6. FIG. 6 is a side view of lighting fixture 1A according to Variation 1.

In lighting fixture 1 described in the embodiment above, first opening 23 is formed in bottom panel 222 of power supply housing 22, but in lighting fixture 1A according to this variation, first opening 23 is formed in first lateral panel 223 of power supply housing 22. In other words, first opening 23 is formed in the same surface (first lateral surface 223*s*) as second opening 24.

Lighting fixture 1A according to this variation has the same technical advantages as Embodiment 1 described above. More specifically, the user can easily perform two types of communication: infrared communication and radio communication.

In particular, in this variation, first opening 23 and second opening 24 are both formed in first lateral surface 223*s*. With this, the user can control lighting fixture 1, such as controlling the dimming, by pointing a remote control (infrared remote control 3 or radio remote control 4) toward first lateral panel 223 (first lateral surface 223*s*), regardless of whether the communication is infrared communication or radio communication. In other words, the user can perform dimming control without having to be aware of which remote control, infrared remote control 3 or radio remote control 4, to operate.

Variation 2

Figure 7:
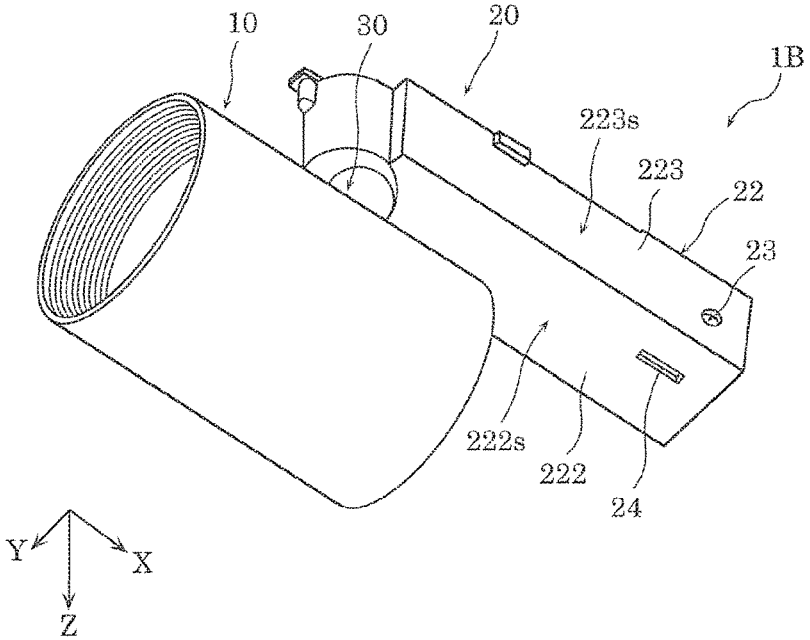
FIG. 7 is a perspective view of a lighting fixture according to Variation 2.
Figure 8:
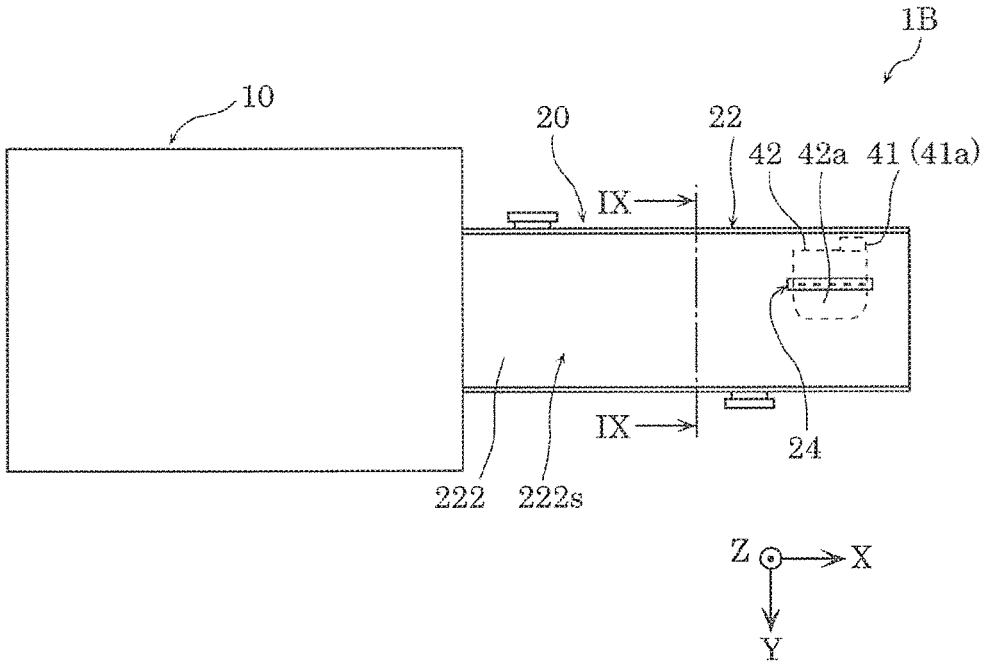
FIG. 8 is a bottom view of a lighting fixture according to Variation 2.
Figure 9:
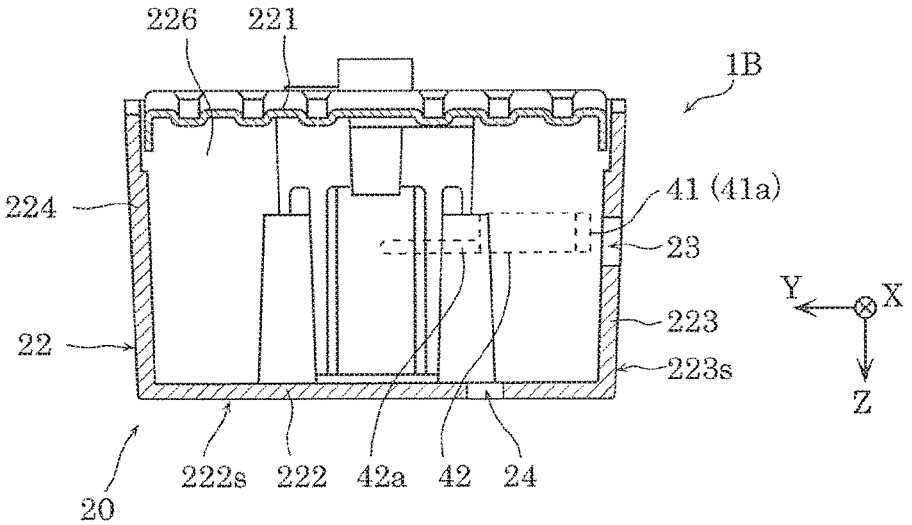
FIG. 9 is a cross sectional view of a lighting fixture according to Variation 2.

Next, lighting fixture 1B according to Variation 2 will be described with reference to FIG. 7 through FIG. 9. FIG. 7 is a perspective view of lighting fixture 1B according to Variation 2. FIG. 8 is a bottom view of the same lighting fixture 1B. FIG. 9 is a cross sectional view of the same lighting fixture 1B.

In lighting fixture 1 described in the embodiment above, first opening 23 is formed in bottom panel 222 of power supply housing 22 and second opening 24 is formed in first lateral panel 223 of power supply housing 22, but in lighting fixture 1B according to this variation, the locations of first opening 23 and second opening 24 are switched: first opening 23 is formed in first lateral panel 223 of power supply housing 22*a* and second opening 24 is formed in bottom panel 222 of power supply housing 22, as illustrated in FIG. 7 through FIG. 9.

Lighting fixture 1B according to this variation has the same technical advantages as Embodiment 1 described above. More specifically, the user can easily perform two types of communication: infrared communication and radio communication.

Moreover, in this variation, the arrangement of radio antenna 42*a* of radio communication circuit 42 is different than in the embodiment described above; radio antenna 42*a* is disposed lying flat. More specifically, radio antenna 42*a* is disposed such that a major surface thereof faces bottom panel 222 in which second opening 24 is formed. Even more specifically, a major surface of radio antenna 42*a* (of the substrate on which an antenna is patterned) is parallel to bottom surface 222*s* of bottom panel 222.

By disposing radio antenna 42*a* so as to lie flat in alignment with second opening 24, radio signals transmitted toward lighting fixture 1 easily reach radio antenna 42*a* through second opening 24. This greatly improves radio communication performance.

Figure 10:
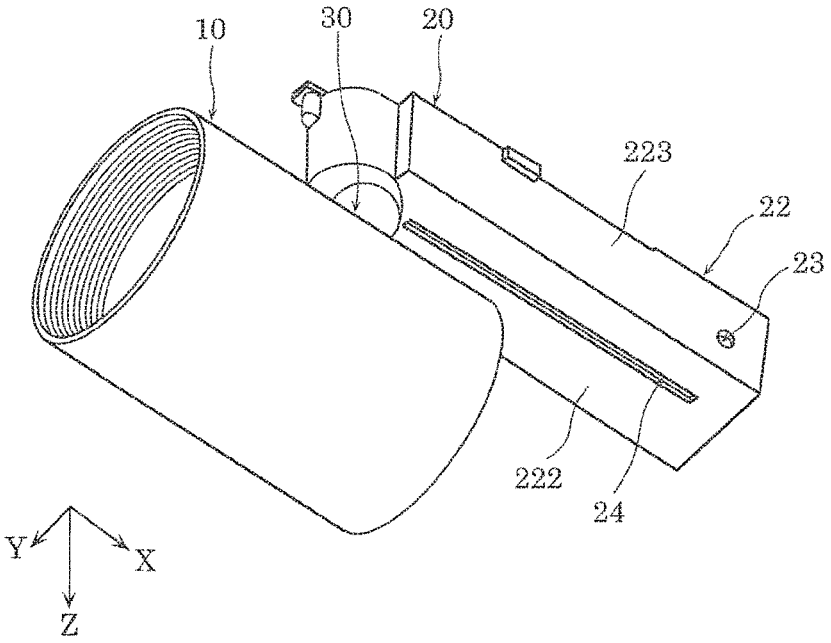
FIG. 10 is a perspective view of another example of a lighting fixture according to Variation 2.

Note that second opening 24 through which radio signals pass is an elongated slit, as illustrated in FIG. 10. In such a case, for example, second opening 24 is a straight line slit having a width of 2 mm and a length of 160 mm, just like in the embodiment described above.

Forming second opening 24 as an elongated slit as described above makes it possible to further improve radio communication performance.

Variation 3

Figure 11:
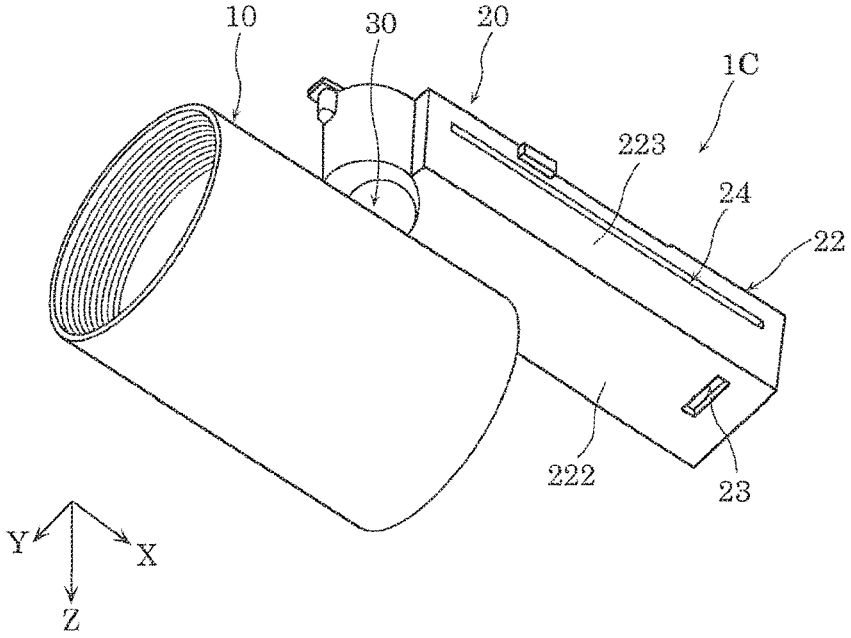
FIG. 11 is a perspective view of a lighting fixture according to Variation 3.

Next, lighting fixture 1C according to Variation 3 will be described with reference to FIG. 11. FIG. 11 is a perspective view of lighting fixture 1C according to Variation 3.

In lighting fixture 1 according to the embodiment described above, first opening 23 is circular in shape, but in lighting fixture 1C according to this embodiment, first opening 23 is elongated. More specifically, in this variation, first opening 23 is rectangular in shape. Note that all other configurations are the same as described in Embodiment 1.

Accordingly, lighting fixture 1C according to this variation also has the same technical advantages as Embodiment 1 described above. More specifically, the user can easily perform two types of communication: infrared communication and radio communication.

Moreover, with this variation, since first opening 23 is elongated, it is possible to give the area in which operation of infrared remote control 3 is possible directionality.

More specifically, by elongating first opening 23, the reception sensitivity of infrared signals by infrared communication receiver 41 (infrared receiver 41*a*) in the lengthwise direction of first opening 23 can be made to be greater than the reception sensitivity of infrared signals by infrared communication receiver 41 (infrared receiver 41*a*) in the widthwise direction of first opening 23.

For example, when a plurality of lighting fixtures IC are arranged in a row, this makes it possible to perform infrared communication with only the intended target lighting fixture 1C. In other words, it is possible to inhibit lighting fixture other than the intended target lighting fixture from also being controlled. For example, this makes it possible to avoid simultaneously dimming a plurality of lighting fixtures.

Variation 4

Figure 12:
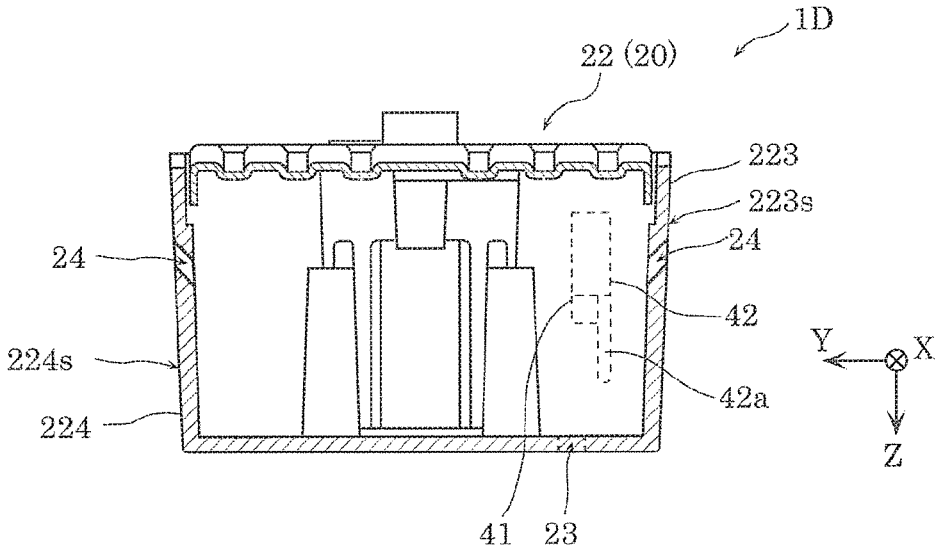
FIG. 12 is a cross sectional view of a lighting fixture according to Variation 4.

Next, lighting fixture 1D according to Variation 4 will be described with reference to FIG. 12. FIG. 12 is a cross sectional view of lighting fixture 1D according to Variation 4.

In lighting fixture 1 according to the embodiment described above, in a cross sectional view of power supply housing 22, such as in FIG. 5, second opening 24 is formed straight through the thickness of first lateral panel 223 (second lateral panel 224), but in lighting fixture 1D according to this variation, in a cross sectional view of power supply housing 22, such as in FIG. 12, second opening 24 is formed diagonally through the thickness of first lateral panel 223 (second lateral panel 224). In other words, second opening 24 is a diagonal slit having a diagonal cross section.

More specifically, in lighting fixture 1 according to the embodiment described above, second opening 24 is formed straight, that is to say, perpendicular to first lateral surface 223*s* of first lateral panel 223 (second lateral surface 224*s* of second lateral panel 224) (i.e., formed parallel to the Y axis), as illustrated in FIG. 5.

In contrast, in lighting fixture 1D according to this variation, in a cross sectional view of power supply housing 22, second opening 24 slopes diagonally toward top panel 221 from the outer surface to the inner surface of first lateral surface 223*s* of first lateral panel 223 (second lateral panel 224) (i.e., slopes diagonally toward the attachment component), as illustrated in FIG. 12. Note that all other configurations are the same as described in Embodiment 1.

Accordingly, lighting fixture 1D according to this variation also has the same technical advantages as Embodiment 1 described above. More specifically, the user can easily perform two types of communication: infrared communication and radio communication.

Moreover, in this variation, since second opening 24 is diagonal in a cross sectional view of power supply housing 22, the design aesthetics of lighting fixture 1D (power supply housing 22) can be improved and radio communication performance can be improved.

In such a case, in this variation, since second opening 24 is formed diagonally through the thickness of first lateral panel 223 (second lateral panel 224) so as to slope toward top panel 221, the design aesthetics of lighting fixture 1D are improved.

In other words, since power supply 20 (power supply housing 22) is, in most cases, attached to an attachment component located above the user's head, most of the time the user looks upward when performing radio communication, but by forming second opening 24 diagonally through the thickness of first lateral panel 223 (second lateral panel 224) so as to slope toward top panel 221, when the user looks upward at power supply housing 22, the inside of power supply housing 22 is not easily visible to the user. Moreover, the presence of second opening 24 itself does not stand out. Accordingly, it is possible to improve the design aesthetics of lighting fixture 1D (power supply housing 22).

Variation 5

Figure 13:
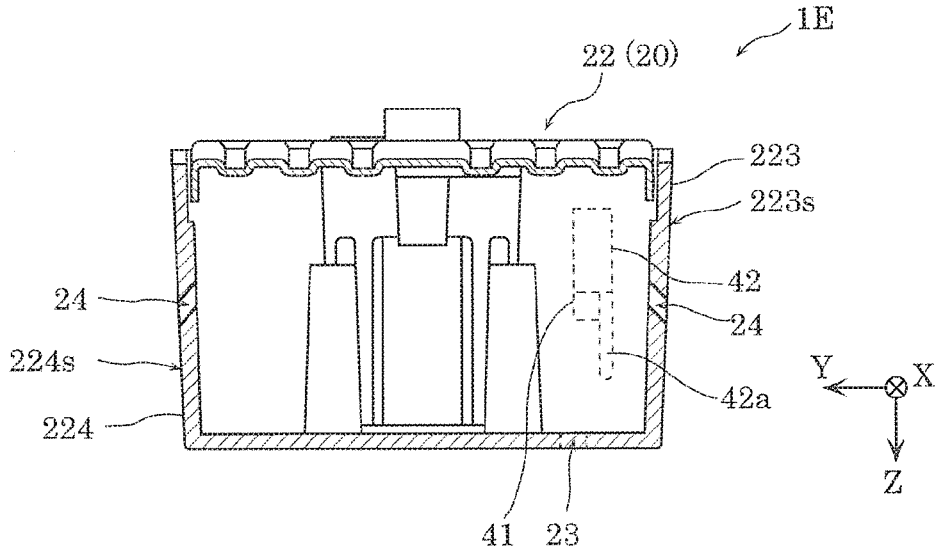
FIG. 13 is a cross sectional view of a lighting fixture according to Variation 5.

Next, lighting fixture 1E according to Variation 5 will be described with reference to FIG. 13. FIG. 13 is a cross sectional view of lighting fixture 1E according to Variation 5.

In lighting fixture 1D according to Variation 4 described above, second opening 24 is formed diagonally through the thickness of first lateral panel 223 (second lateral panel 224) so as to slope toward top panel 221, but in lighting fixture 1E according to this variation, in a cross sectional view of power supply housing 22, such as in FIG. 13, second opening 24 is formed diagonally through the thickness of first lateral panel 223 (second lateral panel 224) so as to slope away from top panel 221. In other words, similar to Variation 4, second opening 24 according to this variation is a diagonal slit having a diagonal cross section, but unlike Variation 4, is formed diagonally through the thickness of first lateral panel 223 (second lateral panel 224) so as to slope toward bottom panel 222.

More specifically, in lighting fixture 1E according to this variation, in a cross sectional view of power supply housing 22, second opening 24 slopes diagonally away from top panel 221 from the outer surface to the inner surface of first lateral panel 223 (second lateral panel 224) of power supply housing 22 (i.e., slopes diagonally away from the attachment component). Note that all other configurations are the same as described in Embodiment 1.

Accordingly, lighting fixture 1E according to this variation also has the same technical advantages as Embodiment 1 described above. More specifically, the user can easily perform two types of communication: infrared communication and radio communication.

In such a case, in this variation, since second opening 24 is formed diagonally through the thickness of first lateral panel 223 (second lateral panel 224) so as to slope away from top panel 221 in a cross sectional view of power supply housing 22, the radio communication performance of lighting fixture 1E is improved.

In other words, since second opening 24 is formed diagonally through the thickness of first lateral panel 223 (second lateral panel 224) so as to slope toward bottom panel 222, when the user points radio remote control 4 upward to transmit a radio signal, the radio signal can easily pass through second opening 24. This improves the radio communication performance of lighting fixture 1E.

Note that radio remote control 4 may be implemented as various types of remote controls, such as a remote control that is attached to the ceiling or a remote control that is attached to the wall, and by selecting an angle of the diagonal second opening 24 that corresponds to all types of radio remote control 4, it is possible to further improve the radio communication performance of lighting fixture 1E.

Other Variations

Hereinbefore, a lighting fixture according to the present disclosure has been described based on an exemplary embodiment, but the present disclosure is not limited to the above embodiment.

Figure 14:
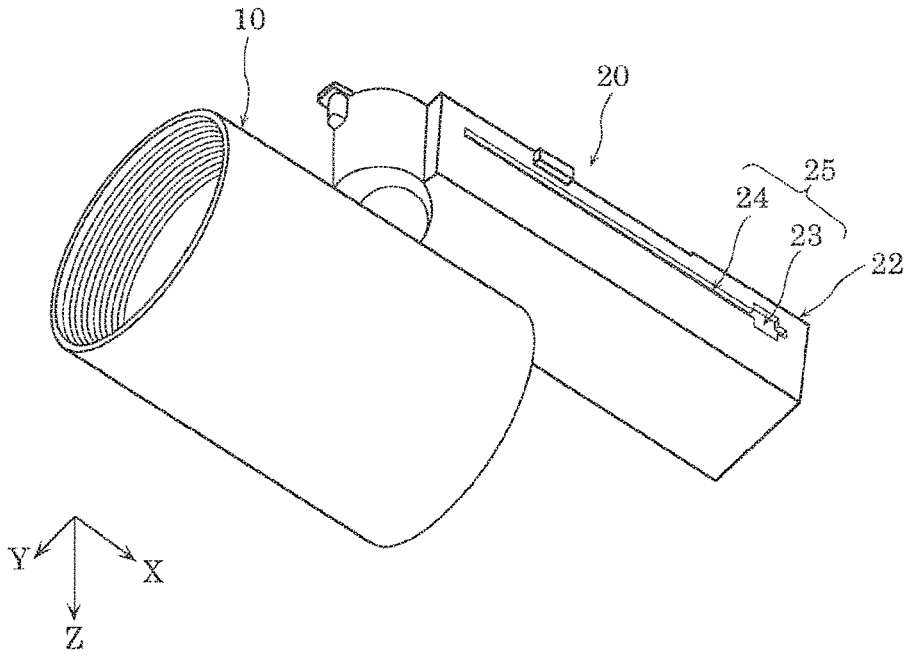
FIG. 14 is a perspective view of a lighting fixture according to Variation 6.
Figure 15:
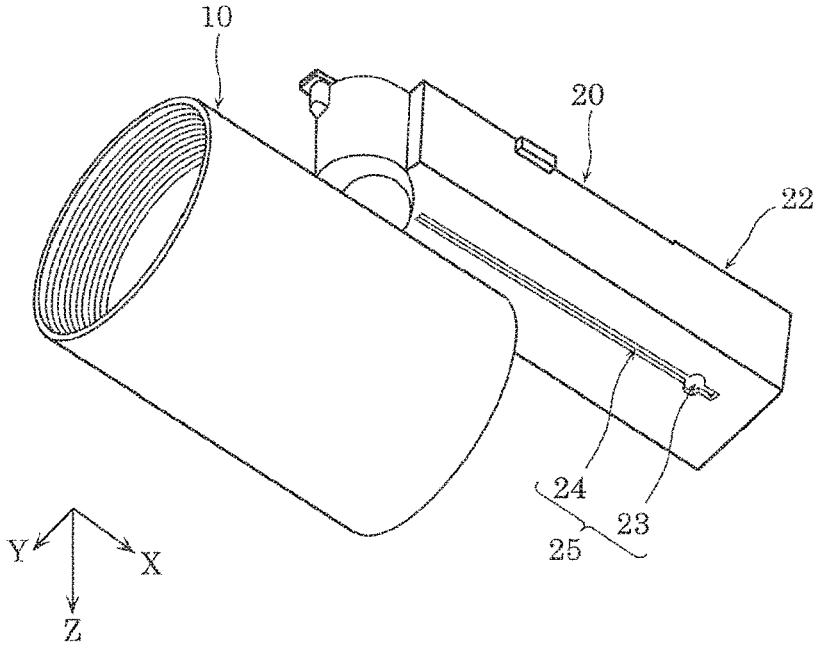
FIG. 15 is a perspective view of a lighting fixture according to Variation

For example, in the above embodiment, first opening 23 and second opening 24 are separate openings, but this example is not limiting. In other words, as illustrated in FIG. 14 and FIG. 15, first opening 23 and second opening 24 may be combined into a single combination opening 25 through which both radio signals and infrared signals pass. Note that in FIG. 14, combination opening 25 is exemplified as being configured of a rectangular first opening 23 and an elongated second opening 24, and in FIG. 15, combination opening 25 is exemplified as being configured of a circular first opening 23 and an elongated second opening 24, but the combination of the shapes of first opening 23 and second opening 24 is not limited to these examples.

Moreover, in the above embodiment, light source 11 is configured to emit white light via usage of blue LEDs and yellow phosphor, but this example is not limiting. For example, a configuration in which blue LEDs are paired with a phosphor-containing resin containing red and green phosphor may be used to produce white light.

Moreover, in the above embodiment, the LEDs are exemplified as blue LEDs, but this example is not limiting. For example, the LEDs may be those that emit light of a color other than blue light, or those that emit ultraviolet light. In such a case, the phosphor to be used may be selected in accordance with the wavelength of the light emitted by the LEDs.

Moreover, in the above embodiments, light source 11 is exemplified as having a COB structure in which LED chips are directly mounted on a mounting substrate, but this example is not limiting. For example, instead of a LED module having a COB structure, a LED module having a surface mount device (SMD) structure may be used. An SMD LED module has a configuration in which one or more package LED elements (SMD LED elements) including a resin package (container) having a cavity, an LED chip (light-emitting element) mounted in the cavity, and a sealant (phosphor-containing resin) filling the cavity are mounted on a mounting substrate.

Moreover, in the above embodiments, LEDs are exemplified as the sources of light used in light source 11, but this example is not limiting. For example, the source of light used in light source 11 may be a semiconductor light-emitting element such as a semiconductor laser, a solid state light-emitting element other than an LED such as an organic or inorganic electroluminescent (EL) element, or an existing lamp such as a fluorescent lamp or a high-luminance lamp.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting fixture for attaching to an attachment component, the lighting fixture comprising:

a lamp including a light source that emits illumination light;

a power supply that includes a power supply circuit that generates power for causing the light source to emit the illumination light and a power supply housing that houses the power supply circuit; and an arm that couples the lamp and the power supply and rotatably supports the lamp, wherein the power supply housing houses an infrared communication receiver that receives an infrared signal for controlling the lighting fixture and a radio communication circuit that receives a radio signal for controlling the lighting fixture, and the power supply housing includes a first opening through which the infrared communication receiver receives the infrared signal.

2. The lighting fixture according to claim 1, wherein the power supply housing includes an attachment surface for attaching to the attachment component, and the first opening is in a surface of the power supply housing that faces an opposite direction from the attachment surface.

3. The lighting fixture according to claim 1, wherein in a view of a surface of the power supply housing which includes the first opening, the first opening is in a location that overlaps an infrared receiver of the infrared communication receiver.

4. The lighting fixture according to claim 1, wherein the first opening is elongated.

5. The lighting fixture according to claim 4, wherein the first opening is one of rectangular and elliptical.

6. The lighting fixture according to claim 1, wherein the first opening is in a location that does not overlap the lamp, regardless of an orientation of the lamp.

7. The lighting fixture according to claim 1, wherein the power supply housing is made of metal, and the power supply housing includes a second opening through which the radio communication circuit receives the radio signal.

8. The lighting fixture according to claim 7, wherein the second opening is an elongated slit.

9. The lighting fixture according to claim 7, wherein the second opening is in a lateral surface of the power supply housing, and the radio communication circuit includes a radio antenna, the radio antenna being disposed such that a major surface of the radio antenna faces the lateral surface.

10. The lighting fixture according to claim 7, wherein in a cross sectional view of the power supply housing, the second opening is diagonal.

11. The lighting fixture according to claim 10, wherein in the cross sectional view of the power supply housing, the second opening slopes diagonally toward the attachment component from an outer surface toward an inner surface of a lateral panel of the power supply housing.

12. The lighting fixture according to claim 10, wherein in the cross sectional view of the power supply housing, the second opening slopes diagonally away from the attachment component from an outer surface toward an inner surface of a lateral panel of the power supply housing.

13. The lighting fixture according to claim 1, wherein the infrared communication receiver receives the infrared signal for controlling a first lighting aspect of the illumination light, and the radio communication circuit receives the radio signal for controlling a second lighting aspect of the illumination light.

* * * * *